US008804969B2

(12) United States Patent
Kim et al.

(10) Patent No.: US 8,804,969 B2
(45) Date of Patent: Aug. 12, 2014

(54) METHOD AND APPARATUS FOR OUTPUTTING SOUND SOURCE SIGNAL BY USING VIRTUAL SPEAKER

(75) Inventors: Young-tae Kim, Seongnam-si (KR); Jung-ho Kim, Yongin-si (KR); Sang-chul Ko, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 961 days.

(21) Appl. No.: 12/076,357

(22) Filed: Mar. 17, 2008

(65) Prior Publication Data

US 2009/0136045 A1 May 28, 2009

(30) Foreign Application Priority Data

Nov. 28, 2007 (KR) ..... 10-2007-0121999

(51) Int. Cl.
*H04R 5/00* (2006.01)
*H04R 5/02* (2006.01)

(52) U.S. Cl.
USPC ..... 381/17; 381/310

(58) Field of Classification Search
USPC ..... 381/1, 17–19, 310
See application file for complete search history.

(56) References Cited

U.S. PATENT DOCUMENTS

| | | | | |
|---|---|---|---|---|
| 6,973,184 | B1 * | 12/2005 | Shaffer et al. | 379/420.01 |
| 7,072,474 | B2 * | 7/2006 | Nelson et al. | 381/17 |
| 7,515,719 | B2 | 4/2009 | Hooley et al. | |
| 2004/0151325 | A1 | 8/2004 | Hooley et al. | |
| 2004/0170281 | A1 * | 9/2004 | Nelson et al. | 381/17 |
| 2006/0204022 | A1 | 9/2006 | Hooley et al. | |
| 2007/0030976 | A1 * | 2/2007 | Konagai | 381/17 |
| 2007/0030977 | A1 | 2/2007 | Konagai | |

OTHER PUBLICATIONS

Korean Office Action issued Dec. 23, 2013 in corresponding Korean Application No. 10-2007-0121999.

* cited by examiner

*Primary Examiner* — Alexander Talpalatski
(74) *Attorney, Agent, or Firm* — Staas & Halsey LLP

(57) ABSTRACT

A method and apparatus for outputting a sound source signal by using a virtual speaker are provided. The method includes generating a virtual sound source signal delayed by a virtual delay value, instead of by the minimum delay value, according to a sampling rate of an input sound source signal, from the input sound source signal; generating a speaker output signal in which a sampling rate is changed based on the input sound source signal and the generated virtual sound source signal; and outputting the generated speaker output signal. Thus, a non-uniform radiation pattern, which causes distortion in a sound radiated from a speaker array, is removed and the limitation of a frequency band of a controllable sound source signal is overcome, thereby providing a stable sound.

10 Claims, 11 Drawing Sheets

METHOD AND APPARATUS FOR OUTPUTTING SOUND SOURCE SIGNAL BY USING VIRTUAL SPEAKER

CROSS-REFERENCE TO RELATED PATENT APPLICATION

This application claims the benefit of Korean Patent Application No. 10-2007-0121999, filed on Nov. 28, 2007, in the Korean Intellectual Property Office, the disclosure of which is incorporated herein in its entirety by reference.

BACKGROUND

1. Field

One or more embodiments of the present invention relates to a method, medium and apparatus for outputting a sound source signal by using a virtual speaker, and more particularly, to a method and apparatus for outputting a sound source signal in order to provide a personal sound zone which delivers a sound having no distortion in terms of sound quality to a user by removing a non-uniform radiation pattern generated from a speaker array system formed of a plurality of speakers.

2. Description of the Related Art

A speaker array combines a plurality of speakers and is used to control a direction in which sound is to be reproduced and to send a sound to a specific area. In order to control a sound to be in a target area or a target direction, an array including variety of sound source signals is needed. In general, a principle of delivering a sound which is known as directivity uses a phase difference of a variety of sound source signals and piles up the signals in order to increase the strength of the signal in a specific direction, thereby delivering the signals in a specific direction. Accordingly, phases of the sound source signals generated through the plurality of the speakers located according to a specific position are controlled so that such directivity can be realized. Such a directivity principle is used to focus a sound to a specific listener's position. An area where a sound field is formed due to focusing is called a personal sound zone.

Hereinafter, the term 'sound source' denotes a source in which a sound is radiated and means a separate speaker which forms a speaker array. The term 'sound field' is a virtual area formed by a sound radiated from a sound source and is used to denote an area to which a sound energy is affected. In addition, the term 'sound pressure' represents the amount by which sound energy is affected, by using a physical quantity of pressure.

Meanwhile, in outputting the sound source signals through the speaker array, a phenomenon occurs in that radiation properties are generated non-uniformly in the sound source signals radiated from each speaker in a position within a specific distance from the speaker array due to insufficient interference. This phenomenon occurs because a sound radiated from a variety of the speakers cannot form a desired sound field in a short distance of the speaker array due to insufficient interference from separate radiated sound source signals. This is called a near field effect. In addition, when a sound field radiated from the speaker array is represented as a visual pattern, such a near field effect is represented as a non-uniform radiation pattern.

SUMMARY OF THE INVENTION

One or more embodiments of the present invention provides a method, medium and apparatus for outputting a sound source signal to solve a problem in that a listener cannot properly sense a direction of a sound due to a non-uniform radiation pattern generated when outputting the sound source signals from speakers forming a speaker array and to overcome limitations in which a frequency band of the sound source signals that is controllable is restricted due to the size of the fixed speaker array.

According to an aspect of the present invention, there is provided a method of outputting a sound source signal, the method including: generating a virtual sound source signal delayed by a virtual delay value, instead of by the minimum delay value, according to a sampling rate of an input sound source signal, from the input sound source signal; generating a speaker output signal in which a sampling rate is changed based on the input sound source signal and the generated virtual sound source signal; and outputting the generated speaker output signal.

According to another aspect of the present invention, there is provided a computer readable recording medium having embodied thereon a computer program for executing the method of outputting a sound source signal.

According to another aspect of the present invention, there is provided an apparatus for outputting a sound source signal, the apparatus including: a virtual signal generator which generates a virtual sound source signal delayed by a virtual delay value, instead of by the minimum delay value, according to a sampling rate of an input sound source signal, from the input sound source signal; a speaker signal generator which generates a speaker output signal in which a sampling rate is changed based on the input sound source signal and the generated virtual sound source signal; and a signal output unit which outputs the generated speaker output signal.

BRIEF DESCRIPTION OF THE DRAWINGS

The patent or application file contains at least one drawing executed in color. Copies of this patent or patent application publication with color drawing(s) will be provided by the Office upon request and payment of the necessary fee. The above and other features and advantages of the present invention will become more apparent by describing in detail exemplary embodiments thereof with reference to the attached drawings in which.

DETAILED DESCRIPTION OF THE INVENTION

Hereinafter, the present invention will be described more fully with reference to the accompanying drawings, in which exemplary embodiments of the invention are shown.

Figure 1:
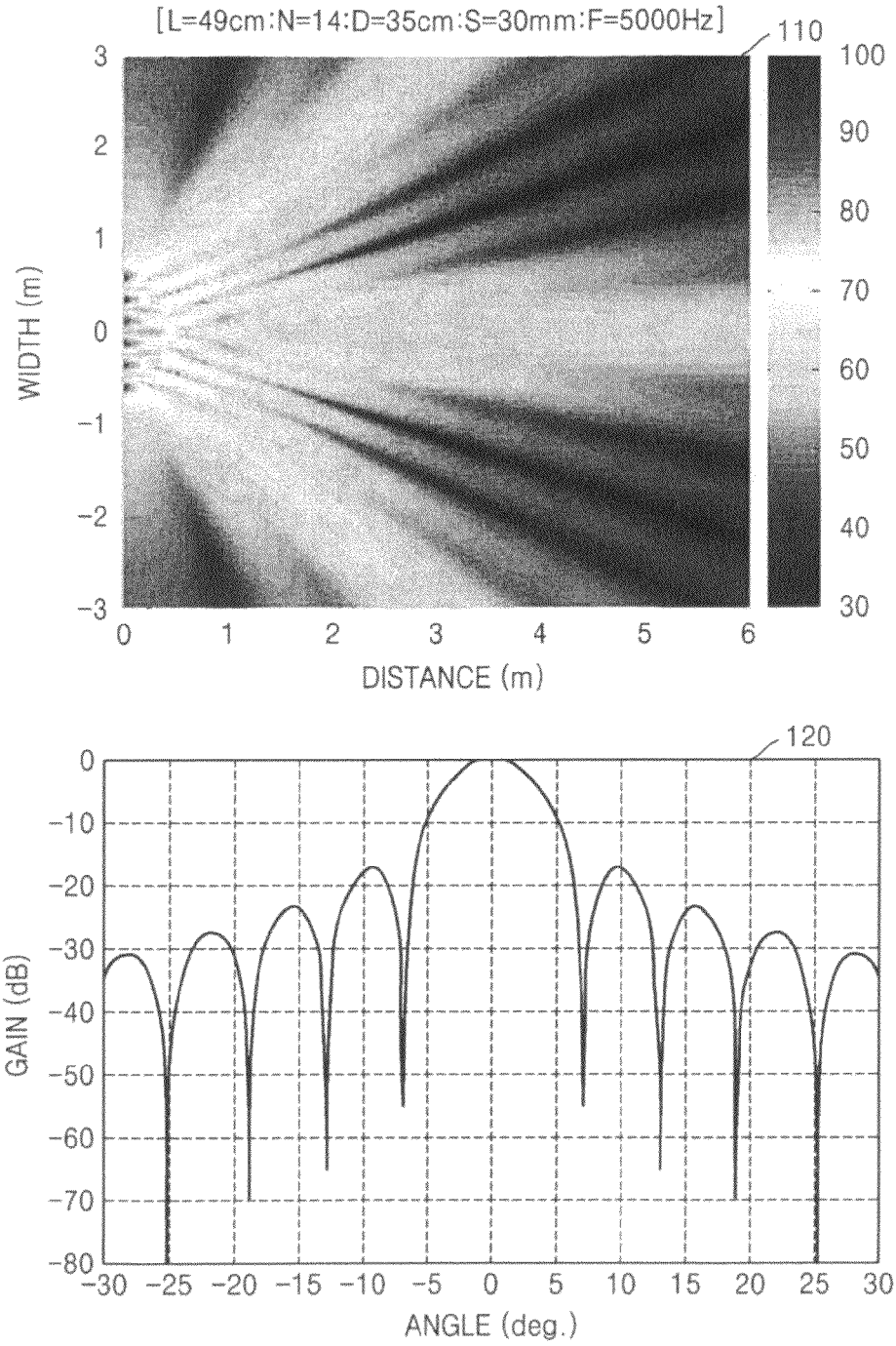
FIG. 1 is a diagram illustrating a non-uniform radiation pattern generated in a speaker array.

FIG. 1 is a diagram illustrating a non-uniform radiation pattern generated in a speaker array. In FIG. 1, a sound field radiated from a speaker array is illustrated in a visual pattern and a graph. A radiation pattern 110 of FIG. 1 illustrates how a radiation property of a sound source signal is changed according to a distance from the speaker array. In the radiation pattern 110, a horizontal axis indicates a distance from the speaker array and a vertical axis indicates a distance from the center of the speaker array to the edge of the speaker array. It is assumed that in the radiation pattern, the speaker array is located in a position where 0 m of the horizontal axis and 0 m of the vertical axis meet. As described above, the near field effect is a phenomenon whereby a sound radiated near the speaker array is distorted and such a near field effect can be determined by identifying a portion where a non-uniform radiation pattern is generated. In the radiation pattern 110, a non-uniform radiation pattern is generated within approximately 1 m of the speaker array. If a listener listens to a sound at a position that is nearer to the speaker array than the distance where the non-uniform radiation pattern is generated, a radiation property is not uniformly controlled so that the listener may experience difficulty in listening to a reproducing sound.

FIG. 1 also illustrates a graph 120 representing a sound field radiated from the speaker array as a beam pattern. A horizontal axis of the beam pattern indicates a radiation angel of a beam focusing on the speaker array and a vertical axis of the beam pattern indicates a gain of a radiated sound source by numbers measured in decibels (dB). The beam pattern denotes that an electric field strength of an electromagnetic wave radiated from a signal output device, such as a speaker and an antenna, is measured and represented in a graph. Such a beam pattern is obtained by receiving a signal from the speaker to be measured by using a measuring device which measures the output signal and by representing the electric field strength received according to each measuring angle as a waveform on a graph or on a polar chart. Thus, the more distant the beam pattern is from the standard point of the graph, the more electric field strength increases and this indicates that directivity exists in the corresponding direction.

In the beam pattern 120, small and thin beam patterns appear on the right and left focusing on a main lobe at the center. The small and thin beam patterns except for the main lobe in which directivity strongly appears are referred to as side lobes and such side lobes are represented as a non-uniform radiation pattern in the radiation pattern 110. As a result, the side lobes or the non-uniform radiation pattern distorts the property of a sound field such as directivity in a sound device and obstructs forming a personal sound zone.

Such a problem of the speaker array occurs because a number of separate speakers formed of the speaker array are not physically continuous. In other words, although separate speakers formed of the speaker array are arranged in a line, a physical gap between the speakers must exist and accordingly, a sound radiated from each of the speakers interact with each other. Thus, a non-uniform radiation pattern appears during forming of a specific sound field. In general, in order to minimize the influence of the side lobes, a gap between the speakers may be narrowed. However, there is a substantial difficulty in reducing the gap. Moreover, the physical size of the speaker array is fixed so that a sound field cannot be properly formed at both ends of the speaker array.

Figure 2:
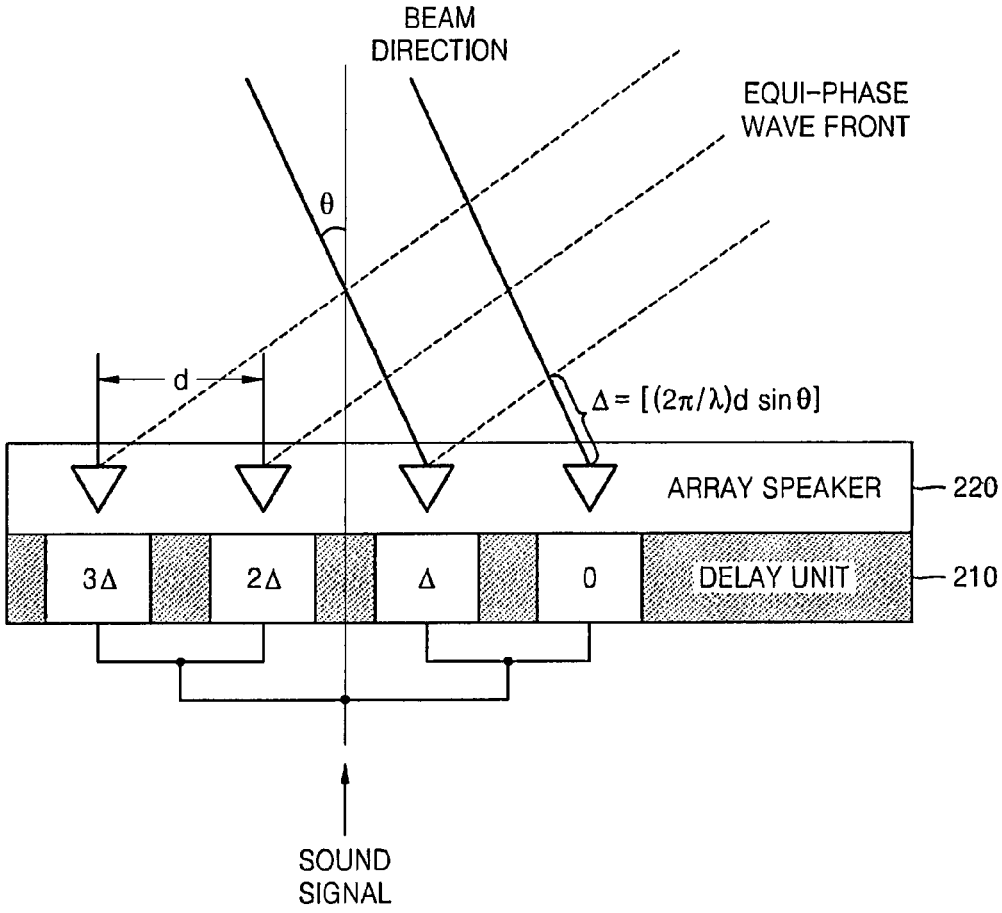
FIG. 2 illustrates a method of delaying a sound source signal in order to realize directivity in a speaker array system.

FIG. 2 illustrates a method of delaying a sound source signal in order to realize directivity in a speaker array system. The method is as follows. First, when one sound source signal is input, the sound source signal is copied as many times as the number of separate speakers formed of the speaker array (or it can be the number of channels to be output). Then, according to an object of processing the sound signals such as a direction of a sound to be generated and a focusing location toward which sound energy is to be focused, an operation of determining how long the sound source signals are delayed is carried out. The above process is described with reference to a delaying unit 210.

In FIG. 2, it is assumed that a speaker array 220 is formed of four separate speakers (indicating channels). Dotted lines illustrated in FIG. 2 are an equi-phase wave front which is a wave front from which sound source signals having equal phases are radiated.

The delaying unit 210 calculates a delay value with respect to each channel and delays each channel by 0, Δ, 2Δ, and 3Δ according to the calculated delay value. As a result, a sound source signal having directivity by θ on the left is generated in the speaker array as illustrated in FIG. 2. Here, the delay value Δ for outputting the sound source signal having directivity by θ on the left is calculated by using Equation 1 below.

$$\Delta = \left[\left(\frac{2\pi}{\lambda}\right)\cdot d\cdot \sin\theta\right] \quad \text{[Equation 1]}$$

Here, Δ is the delay value, λ is a wavelength of a sound source signal to be generated, d is a gap between separate speakers formed of the speaker array, and θ is an angle at the speaker array and a radiation direction of the sound source signal. That is, in the delaying unit 210, a physical property of the speaker array such as the distance d between separate speakers, a characteristic of a sound source to be generated such as the wavelength λ, and variables such as a direction to be output and a focusing location are considered in order to determine the delay value according to each channel.

However, as illustrated above, non-uniform radiation patterns are generated a short distance from the speaker array due to the physical gaps between separate speakers formed of the speaker array. With regard to Equation 1, the more the delay value Δ of each channel decreases, the higher the sampling rate that is required to realize a sound source signal as a digital signal. Here, the sampling rate is the value indicating the number of signal samples per hour taken for converting an analog signal into a digital signal. In order to suppress the generation of such a non-uniform radiation pattern, the higher the number of sound source signal samples per hour that should be taken. However, this will increase the size of the sound sources that are to undergo digital signal processing, thereby imposing a burden on a system. In addition, Equation 1 shows that the delay value Δ and the gap between separate speakers d are in proportion to each other. If the delay value Δ decreases, the gap between separate speakers d should also decrease. However, as described above, there is a difficulty in reducing the gaps between separate speakers d. Accordingly, a method and apparatus for outputting a sound source signal, regardless of the sampling rate, by using a virtual speaker, instead of using the physically fixed speakers, through various embodiments of the present invention will be introduced.

Figure 3A:
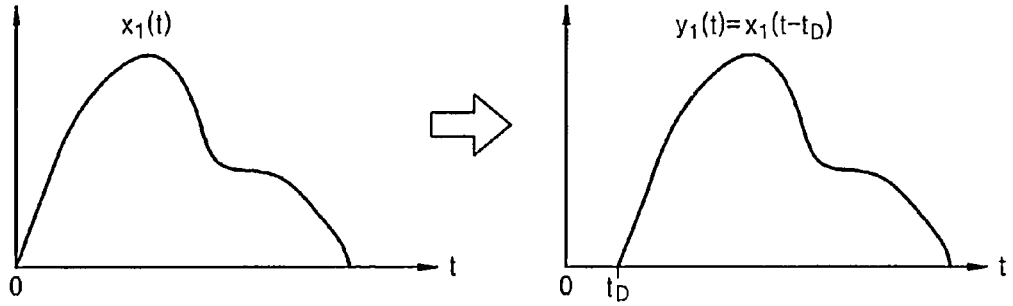
FIGS. 3A and 3B respectively illustrate a method of delaying an analog signal and a digital signal by a predetermined time.
Figure 3B:
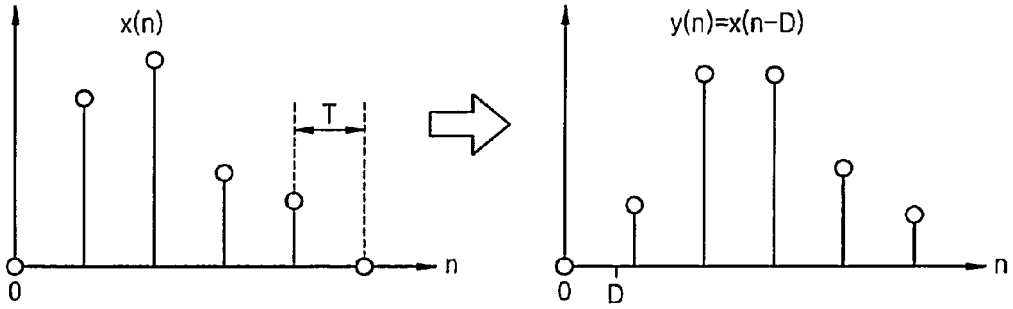

FIGS. 3A and 3B are for explaining a basic principle of one or more embodiments of the present invention and respectively illustrate a method of delaying an analog signal and a digital signal by a predetermined time.

FIG. 3 is a graph illustrating delaying a continuous time signal by a predetermined time. A horizontal axis of the graph indicates time and a vertical axis of the graph indicates the magnitude of a signal. In FIG. 3, the continuous time signal moves to the right by the time $t_D$ while maintaining the magnitude and the form of the signal. However, such a continuous time signal is a waveform of an analog signal and is different from a digital signal which will be illustrated by the embodiments of the present invention. In general, a digital signal takes an analog signal according to a period of the sampling rate by using a buffer of a system and extracts some samples of the original signal. Accordingly, the digital signal is a discrete time signal (also referred to as a non-continuous time signal) and is delayed by as much as the sampling period. A limitation which may occur in delaying a digital signal is described with reference to FIG. 3B.

FIG. 3B is a graph illustrating delaying a discrete time signal by a predetermined time. A horizontal axis of the graph indicates an index of a sampled signal and a vertical axis of the graph indicates the magnitude of a signal. In addition, it is assumed that a sampling interval of the discrete time signal is T. When the discrete time signal is delayed by a predetermined time in FIG. 3B, the magnitude of each of the discrete time signals is not maintained and is delayed by D. Since the discrete time signal generates a signal according to the specified sampling rate, when the sampling interval and the time to be delayed do not match, the magnitude of the sampled signal is changed and thus it is not possible to accurately realize a desired signal.

If the time to be delayed at intervals spaced far apart from one another corresponds to a multiple of the sampling interval, the magnitudes of the signals may be matched. However, in general, magnitudes of signals are not matched in most cases. Delaying the discrete time signal illustrated in FIG. 3B can be defined as given by Equation 2.

$$x(n) \rightarrow z^{-D} \rightarrow y(n) = x(n-D) \quad \text{[Equation 2]}$$

Here, x(n) denotes an original discrete time signal and y(n) is the discrete time signal in which x(n) is delayed by D. $z^{-D}$ denotes changing from the frequency domain. In FIG. 3B, when the sampling interval T and the time to be delayed do not match, such sampled signals cannot be obtained by simply delaying the discrete time signal but can be obtained by reconverting the original analog signal into a digital signal by re-sampling.

Therefore, the minimum delay value which can be processed in a digital signal processing system is limited by the sampling rate. In other words, as long as the digital signal processing system does not change the sampling rate to be higher, there is a structural limitation that the delay value that is smaller than the sampling rate cannot be realized.

In the embodiments of the present invention, problems illustrated above are considered and the virtual speakers having smaller gaps than those of the physically fixed speakers are used so that a sound source signal is delayed by the delay value that is smaller than the sampling rate of the discrete time signal, thereby overcoming the limitations illustrated above. The configuration therefor is described with reference to FIG. 4.

Figure 4:
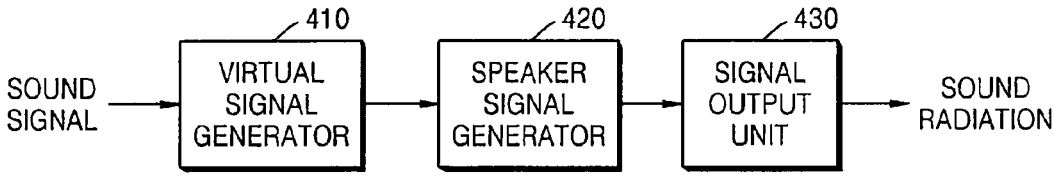
FIG. 4 is a block diagram of an apparatus for outputting a sound source signal by using a virtual speaker, according to an embodiment of the present invention.

FIG. 4 is a block diagram of an apparatus for outputting a sound source signal by using a virtual speaker, according to an embodiment of the present invention.

The apparatus for outputting a sound source signal includes a virtual signal generator 410, a speaker signal generator 420, and a signal output unit 430.

The virtual signal generator 410 generates a sound source signal delayed by a virtual delay value, instead of the minimum delay value according to the sampling rate of the input sound source signal, from the input sound source signal. Here, the minimum delay value (also referred to as a unit delay value) denotes the smallest delay value which can be used without re-sampling by performing sampling rate conversion according to the sampling rate of the sound source signal. As described with reference to FIG. 3B, the sampling rate determines the minimum delay value of the sound source signal. Accordingly, it is not possible to delay the sound source signal by the delay value that is smaller than the minimum delay value without performing the sampling rate conversion. The virtual signal generator 410 can delay the sound source signal, regardless of the minimum delay value, by using the virtual delay value, instead of using the minimum delay value. The above processes will be described in more detail with reference to FIGS. 5 to 7.

Figure 5:
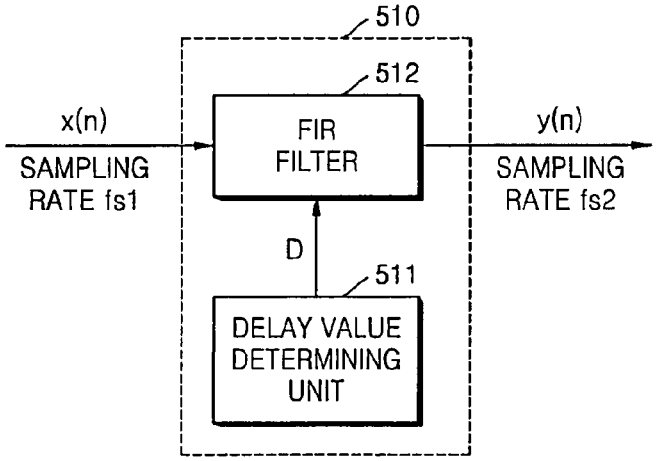
FIG. 5 is a block diagram illustrating in more detail a virtual signal generator in an apparatus for outputting a sound source signal, according to an embodiment of the present invention.

FIG. 5 is a block diagram illustrating in more detail a virtual signal generator 510 in an apparatus for outputting a sound source signal, according to an embodiment of the present invention. The virtual signal generator 510 includes a delay value determining unit 511 and a filter 512.

The delay value determining unit 511 considers the minimum delay value according to the sampling rate and determines a virtual delay value. The virtual delay value may be generally smaller than the minimum delay value and can be determined regardless of the sampling rate. In addition, the delay value determining unit 511 calculates the virtual delay value in advance according to whether the virtual speaker exist within the intervals of separate speakers formed of the speaker array, so as to determine a specific value. For example, if it is assumed that the delay value of separate speakers is Δ and that the virtual speaker exists in the middle of separate speakers, the delay value determining unit 511 determines the delay value as Δ/2.

The filter 512 filters an input sound source signal according to the virtual delay value determined by the delay value determining unit 511. Filtering by the filter 512 will be described in more detail with reference to FIG. 6.

Figure 6:
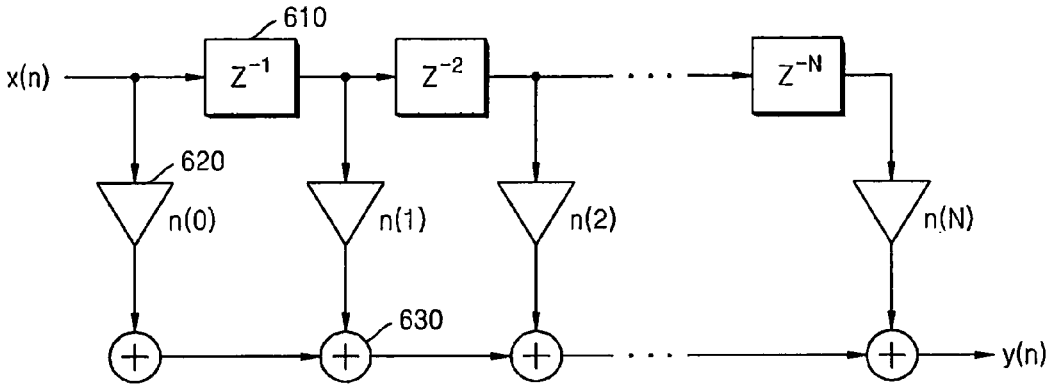
FIG. 6 is a block diagram of a filter for outputting a delay signal in an apparatus for outputting a sound source signal, according to an embodiment of the present invention.

FIG. 6 is a block diagram of a filter for outputting a delay signal in an apparatus for outputting a sound source signal, according to an embodiment of the present invention. In FIG. 6, an Nth finite impulse response (FIR) filter enabling the processing of N delays with respect to the input sound source signal is illustrated. The Nth FIR filter includes an N delaying unit 610 and an N adder unit 630.

As described above, a digital signal can be delayed by as much as the period of the sampling rate by using a buffer. In FIG. 6, input signals are respectively delayed by a predetermined time by using an N delaying unit 610 and the delayed signals are added together by the adder unit 630. Such an FIR filter is defined as given by Equation 3.

$$H(z) = \sum_{n=0}^{N} h(n) \cdot z^{-n} \quad \text{[Equation 3]}$$

Here, h(n) denotes a filter coefficient 620 multiplied by the delayed signal and H(z) denotes the whole FIR filter. That is, Equation 3 is represented by the sum total of the values in which the signals delayed by the delaying unit 610 are multiplied by each of the filter coefficients 620. Each of the filter coefficients 620 can be determined in order to obtain the whole FIR filter.

Hereinafter, a method of obtaining filter H(z) will be described with reference to FIG. 7.

Figure 7:
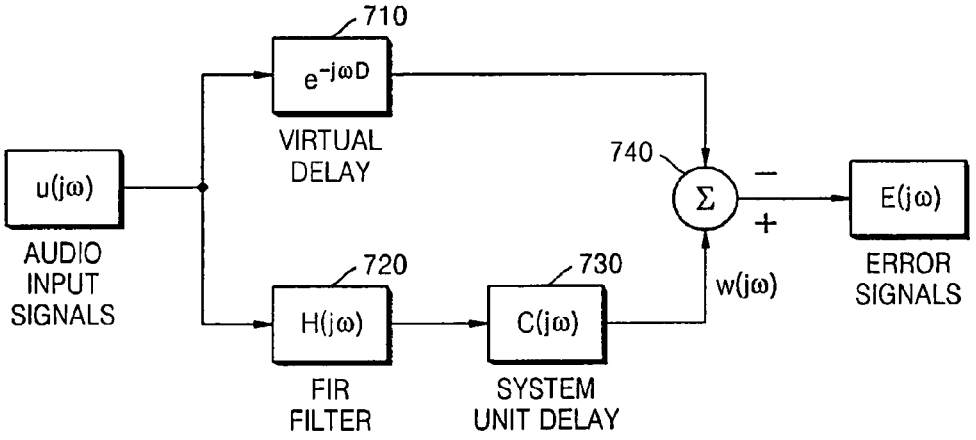
FIG. 7 illustrates a method of determining a coefficient of a filter filtering an input sound source signal in an apparatus for outputting a sound source signal, according to an embodiment of the present invention.

FIG. 7 illustrates a method of determining a coefficient of a filter filtering an input sound source signal in an apparatus for outputting a sound source signal, according to an embodiment of the present invention. An open-loop feed-forward system is illustrated in FIG. 7.

The open-loop feed-forward system is for controlling variables which may be included in a specific configuration of a signal processing system, in order for the signal processing system to output results desired by an administrator or a user. Also, the open-loop feed-forward system uses a predictive control method which changes the result of system output by detecting a control value without having a close-loop in which measuring and performing a series of processes forming of the system are repeated. A more detailed operation principle of the open-loop feed-forward system can be easily understood by one of ordinary skill in the art to which the embodiment pertains.

The open-loop feed-forward system of FIG. 7 includes a target process 710 (corresponding to a virtual delay value), a FIR filter 720, a system process 730 (corresponding to the minimum delay value), and a subtraction unit 740.

In order to determine a filter in the target process 710, a sound source signal delayed by a virtual delay value is firstly defined as a target signal. Since such a target signal is determined under an ideal environment, the target signal can be calculated in advance and is given as a specific parameter. Then, the filter is controlled to minimize the difference between the delay signal of the system process 730 and the defined target signal in the FIR filter 720. That is, the filter of the substantial system is controlled so that the delay signal can approach an ideal signal. When the target signal and the delay signal of the substantial system generated as above are subtracted through the subtraction unit 740, the difference value of both signals theoretically becomes 0. Here, an FIR filter H(z) is determined. Determining the FIR filter by using the difference value is simply represented by Equation 4.

$$E(e^{j\omega})=H(e^{j\omega})-H_{id}(e^{j\omega}) \quad \text{[Equation 4]}$$

Equation 4 represents the difference value $E(e^{j\omega})$ between the delay signal of the system $H(e^{j\omega})$ and the ideal target signal $H_{id}(e^{j\omega})$. The filter can be determined when such a difference value $E(e^{j\omega})$ is minimized.

In FIG. 7, the time domain is converted to the frequency domain (z) for convenience of calculation and all processes and variables are calculated. Thus, determining H(z) can be represented in a matrix multiplication as follows.

$$w=e^{-j\omega D}\cdot u \quad \text{[Equation 5]}$$

Equation 5 represents a virtual delay signal and is a multiplication of the input signal u and the target process $e^{-j\omega D}$.

$$w=C\cdot H\cdot u \quad \text{[Equation 6]}$$

Equation 6 represents a signal delayed through the FIR filter and is a multiplication of the input signal u, the FIR filter H, and the system process C.

Equations 5 and 6 are re-arranged according to w and are represented by Equation 7.

$$e^{-j\omega D}\cdot u=C\cdot H\cdot u$$

$$e^{-j\omega D}=C\cdot H \quad \text{[Equation 7]}$$

Here, an inverse of a matrix $C^{-1}$ of system process C is multiplied by both sides of Equation 7 and is represented by Equation 8.

$$H=C^{-1}\cdot e^{-j\omega D} \quad \text{[Equation 8]}$$

The FIR filter to be obtained is consequently determined as given by Equation 8. However, Equation 8 can be calculated under ideal conditions where matrix C is square and non-singular. Thus, calculation of an inverse of a matrix is limited in a substantial realization. Accordingly, H in Equation 9 below is obtained through an approximate value. A method of obtaining such an approximate value includes least square estimation.

$$H=C^{+}\cdot e^{-j\omega D} \quad \text{[Equation 9]}$$

(where $C^{+}=[C^{H}\cdot C]^{-1}\cdot C^{H}$)

Here, $C^{+}$ denotes a pseudo-inverse of C and $C^{H}$ denotes a Hermitian transpose.

As mentioned above, the method of determining a coefficient of a filter in the virtual signal generator 410 of FIG. 4 is described with reference to FIGS. 5 to 7. The virtual signal generator 410 filters the input signal according to the coefficient controlled as above and generates the virtual sound source signal in which the sampling rate is changed.

Then, the speaker signal generator 420 generates a speaker output signal, in which the sampling rate is changed, based on the input sound source signal and the virtual sound source signal delayed through the virtual signal generator 410. The speaker signal generator 420 includes a signal synthesizing unit (not illustrated) which synthesizes another sound source signal delayed according to a unit delay value from the input sound source signal with the virtual sound source signal. Finally, the signal output unit 430 outputs the speaker output signal generated through the speaker signal generator 420. The above processes are described in more detail with reference to FIGS. 8A and 8B.

Figure 8A:
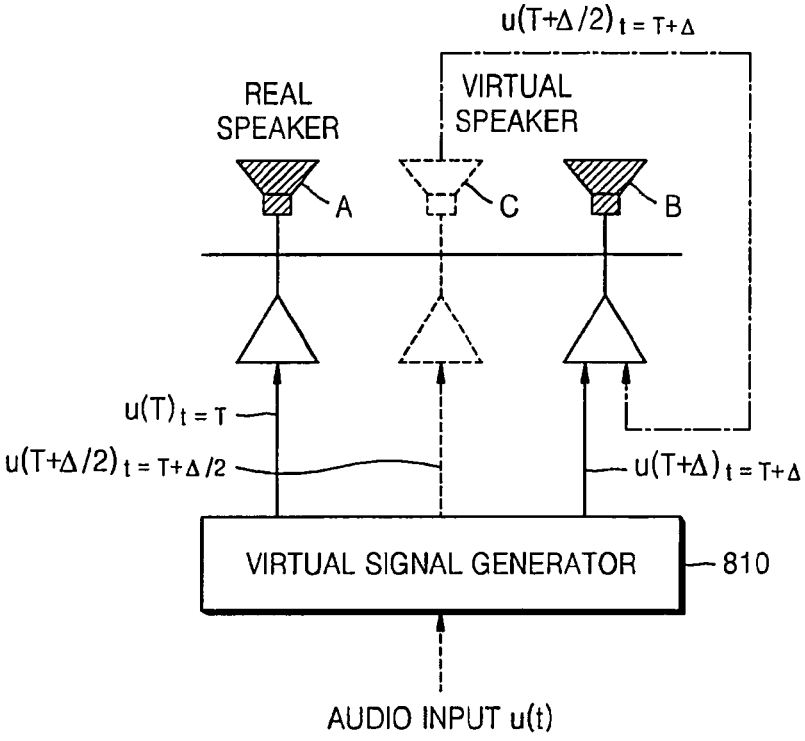
FIGS. 8A and 8B illustrate a method of outputting a speaker output signal from an apparatus for outputting a sound source signal, according to an embodiment of the present invention.

FIG. 8A illustrates a method of outputting a speaker output signal from an apparatus for outputting a sound source signal, according to an embodiment of the present invention.

In FIG. 8A, speakers A and B are real speakers formed of a speaker array and a speaker C is a virtual speaker located between the actual speakers A and B. Such a virtual speaker is a speaker that is assumed to theoretically exist in a specific location, instead of a physical speaker which actually exists. The virtual speaker is a conceptual speaker introduced to receive a virtual sound source signal delayed by a specific value which will be described below.

Meanwhile, a virtual signal generator 810 generates the virtual sound source signal described above. However, in the current embodiment, the virtual signal generator 810 also supplies the delayed sound source signals to be applied to the real speakers. The signals delayed by a multiple of the minimum delay value according to the sampling rate will be applied to the real speakers.

Firstly, the speakers A and B respectively receive the sound source signals $u(t)_{t=T}$ and $u(t+\Delta)_{t=T+\Delta}$ from the virtual signal generator 810 and outputs the sound source signals. Δ denotes the delay value and is determined by the sampling rate of the sound source signal described above. Each of separate speakers formed of the speaker array outputs the sound source signals delayed by Δ, compared with the speakers adjacent to each other, so that the speaker B outputs the sound source signal delayed by Δ, compared with that of the speaker A.

If the delay value Δ is the minimum delay value, the apparatus for outputting a sound source signal according to the current embodiment cannot process the delay value that is smaller than Δ without sampling. Accordingly, the virtual speaker C is located in the right center between the actual speakers A and B. The virtual signal generator 810 generates the virtual sound source signal $u(t+\Delta/2)_{t=T+\Delta/2}$ that is delayed by Δ/2 compared with the signal $u(t)_{t=T}$ applied to the actual speaker A and applies the virtual sound source signal $u(t+\Delta/2)_{t=T+\Delta/2}$ to the virtual speaker C. That is, the actual speaker A, the virtual speaker C, and the actual speaker B sequentially output the sound source signals. However, since the virtual speaker does not actually exist, the virtual speaker cannot output a physical sound source signal. Thus, the sound source signal to be output from the virtual speaker C is output through the actual speaker B which is located right next to the virtual speaker C and substitutes for the virtual speaker C. In other words, the actual speaker B synthesizes the signal $u(t+\Delta)_{t=T+\Delta}$ to be originally output by the actual speaker B with the signal $u(t+\Delta/2)_{t=T+\Delta/2}$ to be output from the virtual speaker C and outputs the synthesized signal. Such a synthesized signal becomes a speaker output signal having a sampling rate that is different from the sampling rate of the original input signal.

Figure 8B:
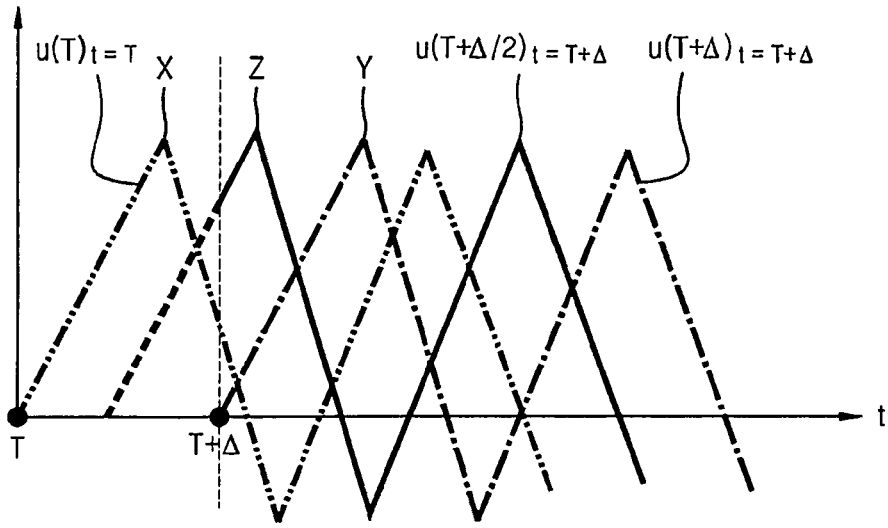

FIG. 8B illustrates a method of outputting a speaker output signal from an apparatus for outputting a sound source signal of FIG. 8A according to the time sequence. A horizontal axis of the graph indicates the time and a vertical axis of the graph indicates the sound source signals. In FIG. 8B, graphs X, Y, and Z respectively indicate the sound source signals applied to the speakers A, B, and C. Firstly, the signal X is applied to the actual speaker A at the time T and the signal Y is applied to the actual speaker B at the time T+Δ. Meanwhile, the signal Z is applied to the virtual speaker C at the time T+Δ/2 that is between the times T and T+Δ. However, the speaker C is a virtual speaker so that the signal is output through the actual speaker B after the time T+Δ. Accordingly, the signal Z is illustrated as a dotted line in the section between T+Δ/2 and T+Δ.

The entire apparatus for outputting a sound source signal by using the virtual speaker of FIG. 4 is described above. According to the current embodiment, the virtual speaker having a gap that is smaller than that of separate speakers formed of the speaker array is used and thus the sound source signal corresponding to the delay value that is smaller than the sampling rate of the discrete time signal can be generated. Consequently, the near field effect and a non-uniform radiation pattern occurring due to discontinuous arrangement of the speakers are suppressed and listeners can properly sense directivity of a sound. In addition, the limitation that a frequency band of a controllable sound source signal is restricted due to the size of the fixed speaker array can be overcome.

Figure 9A:
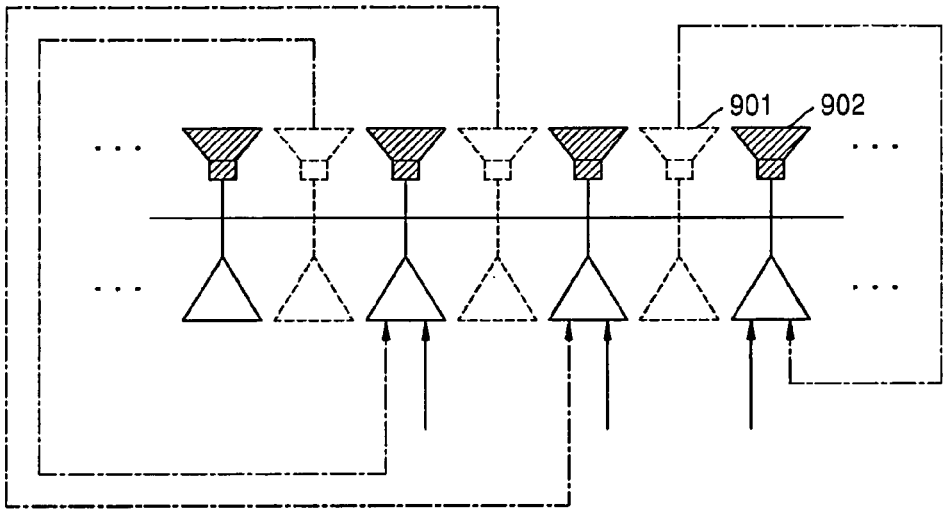
FIGS. 9A through 9C illustrate a method of synthesizing a speaker output signal in an apparatus for outputting a sound source signal, according to an embodiment of the present invention.
Figure 9B:
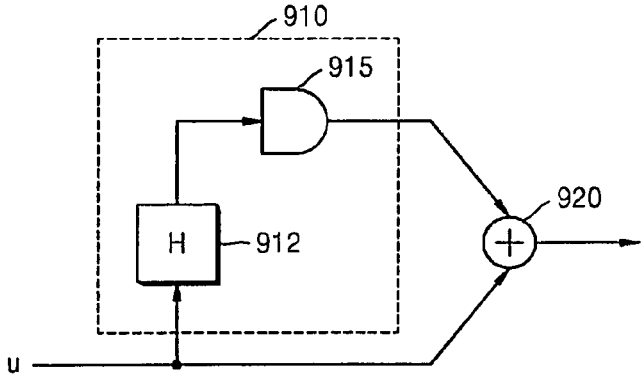
Figure 9C:
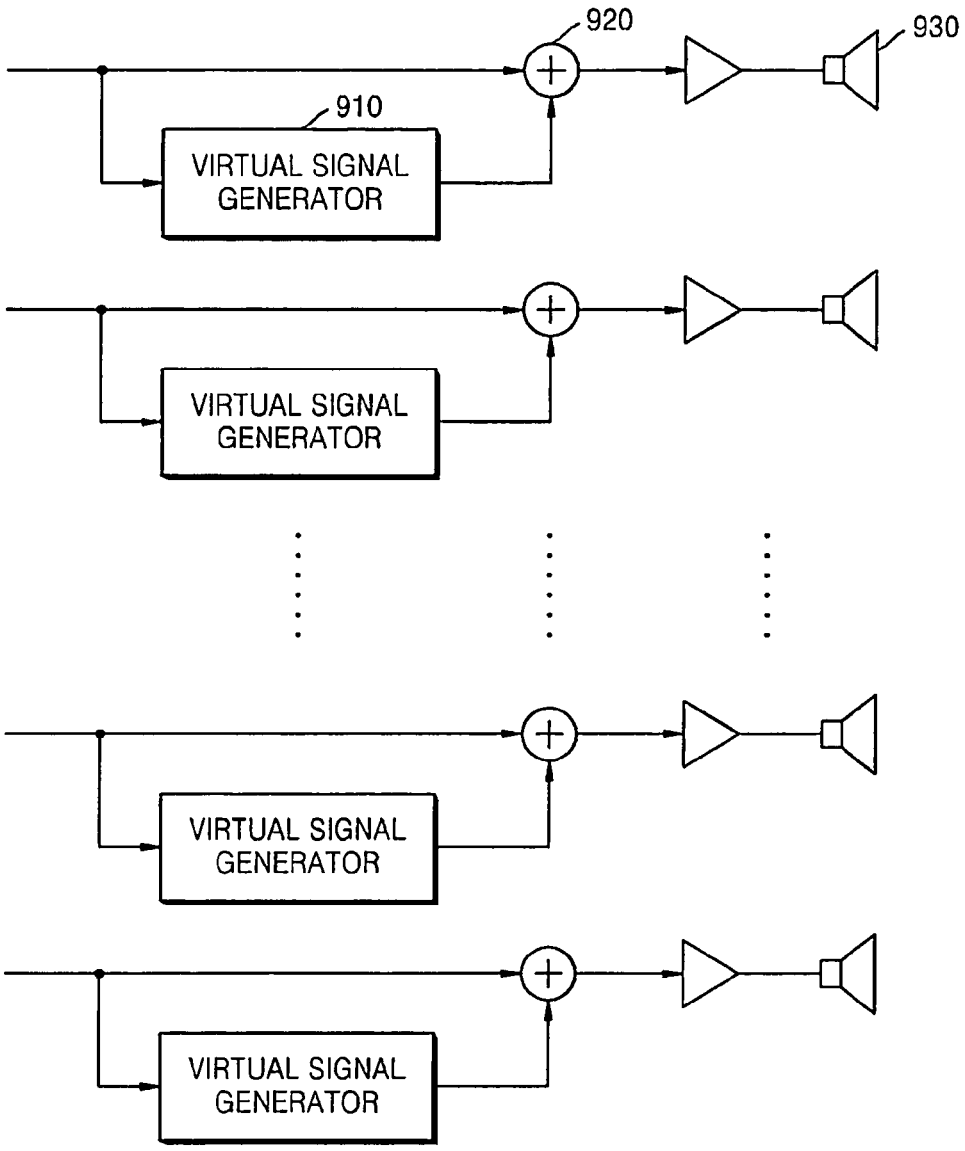

FIGS. 9A through 9C illustrate a method of synthesizing a speaker output signal in an apparatus for outputting a sound source signal, according to an embodiment of the present invention. In FIGS. 9A through 9C, various embodiments to realize a real speaker array system by using the apparatus for outputting a sound source signal as described above are illustrated.

In FIG. 9A, a virtual speaker 901 is located between actual speakers 902 and a virtual sound source signal applied to the virtual speaker 901 is output through the actual speakers 902 adjacent to the virtual speaker 901. When the gap between the actual speakers is d, the sound source signals are synthesized and output by using the virtual speaker so that the gap between the speakers is d/2. If more virtual speakers are used, the real speakers that are discontinuously arranged are relatively arranged approximating a continuous form and accordingly, an occurring non-uniform radiation pattern can be suppressed.

In FIG. 9B, the delayed virtual signal generated by a virtual signal generator 910 is synthesized with the original sound source signal. In FIG. 9B, the virtual signal generator 910 including a filter 912 and a compensation unit 915 and a signal synthesizing unit 920 are illustrated. As described above with reference to FIGS. 5 and 6, the filter 912 controls a delay value and generates a virtual sound source signal. However, when the virtual sound source signal is synthesized as it is with the original sound source signal, a sound pressure may be changed or a directivity pattern may not appear as a user desires. Accordingly, the compensation unit 915 compensates a gain or a directivity characteristic with respect to the delayed virtual sound source signal through the filter 912. Finally, the signal synthesizing unit 920 synthesizes the sound source signal delayed according to the minimum delay value from the input sound source signal with the virtual sound source signal generated through the virtual signal generator 910, thereby outputting the speaker output signal in which the sampling rate is changed.

In FIG. 9C, the speaker output signal described with reference to FIG. 9B is generated in the speaker array formed of a plurality of speakers. Referring to FIG. 9C, the virtual signal generator 910 and the signal synthesizing unit 920 are included in each speaker and the synthesized sound source signals are output through each speaker 930. In other words, the virtual signal generator 910 and the signal synthesizing unit 920 are prepared for as many as the number of channels in the speaker array and the delayed virtual signal is synthesized with the sound source signal to be output from the real speaker, thereby delaying the speaker output signal regardless of the sampling rate.

According to the embodiments above, the virtual speaker having a gap that is smaller than that of separate speakers formed of the real speaker array is used and thus the sound source signal corresponding to the delay value that is smaller than the sampling rate of the discrete time signal can be generated. In particular, a gain and a directivity characteristic of the virtual sound source signal is compensated so that a more accurate speaker output signal can be obtained.

Figure 10A:
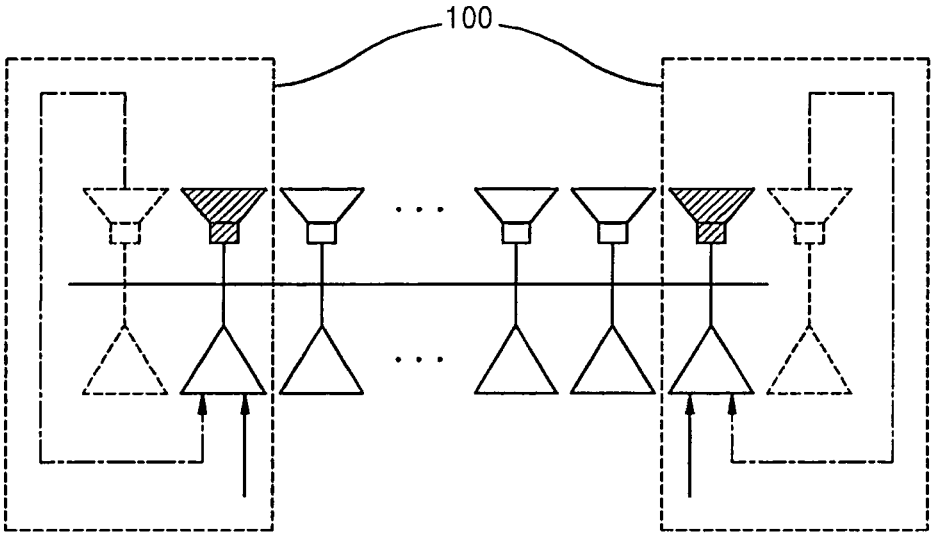
FIGS. 10A and 10B illustrate a method of expanding a size of a speaker array in an apparatus for outputting a sound source signal, according to another embodiment of the present invention.
Figure 10B:
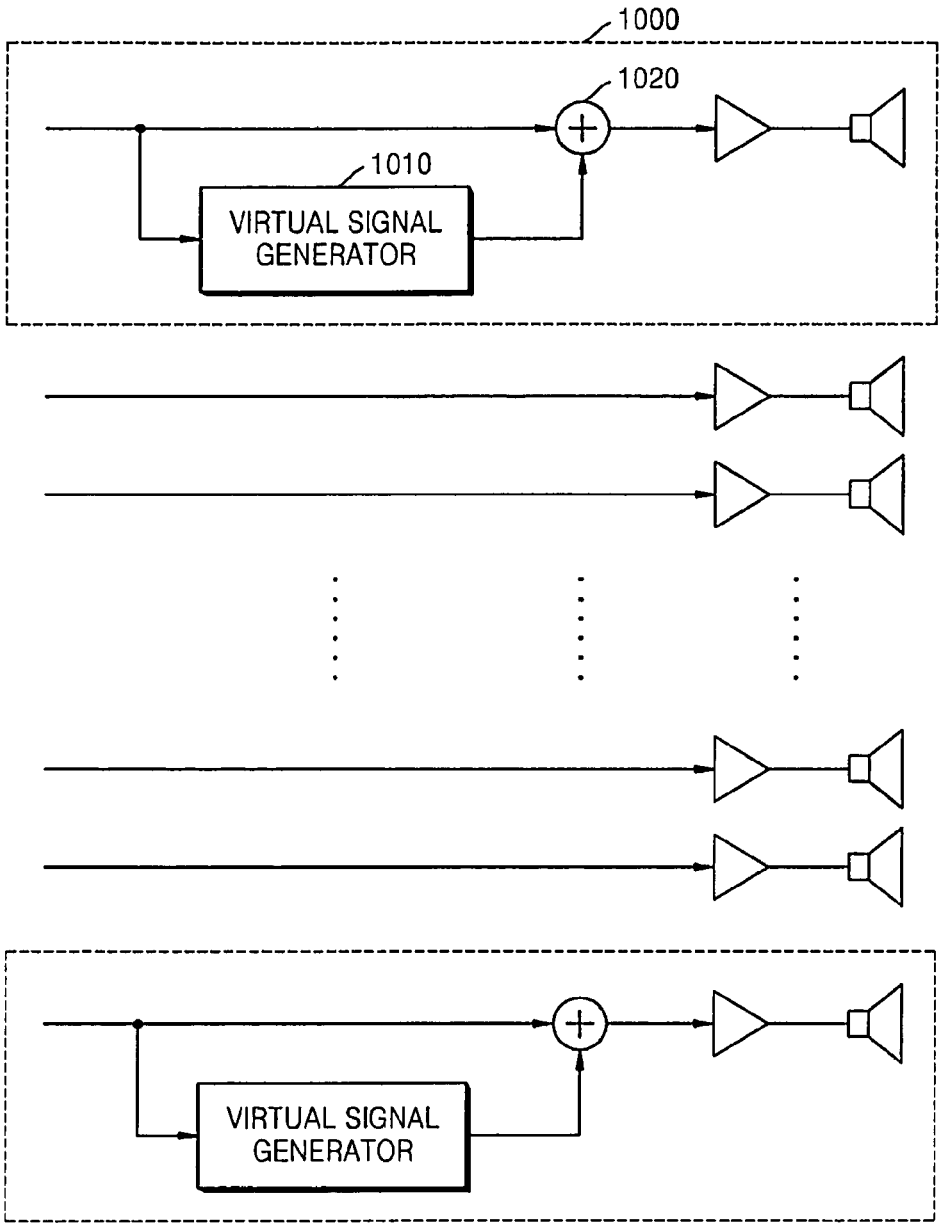

FIGS. 10A and 10B illustrate a method of expanding a size of a speaker array in an apparatus for outputting a sound source signal, according to another embodiment of the present invention.

In general, the speaker array is physically fixed at a specific size and an output signal radiated from the speaker is insufficient at both ends of the speaker array, thereby outputting a truncation error in which a directivity pattern is not properly formed. In order to solve such a problem, the virtual speakers are located at both ends of the real speakers and the virtual sound source signals to be applied to the virtual speakers are generated to output through both ends of the real speakers. Accordingly, an effect, as if the entire size of the speaker array is by the gap between the virtual speakers, manifests. In other words, the speaker arrays with the expanded size can be used without changing the size of the physical speaker array.

In FIG. 10A, the virtual sound source signals to be applied to the virtual speakers located at both ends 100 of the speaker array are generated through the real speakers located at both ends 1000 of the speaker arrays. In this case, the virtual speakers are not used in the rest of the speaker array, except for both ends of the speaker array, or the virtual speakers are selectively used, if necessary.

In FIG. 10B, the speaker array illustrated in FIG. 10A is illustrated in more detail. Referring to FIG. 10B, a virtual signal generator 1010 and a signal synthesizing unit 1020 are included only in the real speaker located at both ends 100 of the speaker array.

According to the above embodiments, the virtual sound source signals to be applied to the virtual speakers from both ends of the speaker array are generated through the real speakers located at both ends and thus the size of the real speaker array is expanded. As a result, the problem that a directivity pattern is not properly formed at both ends of the speaker array can be solved.

Figure 11:
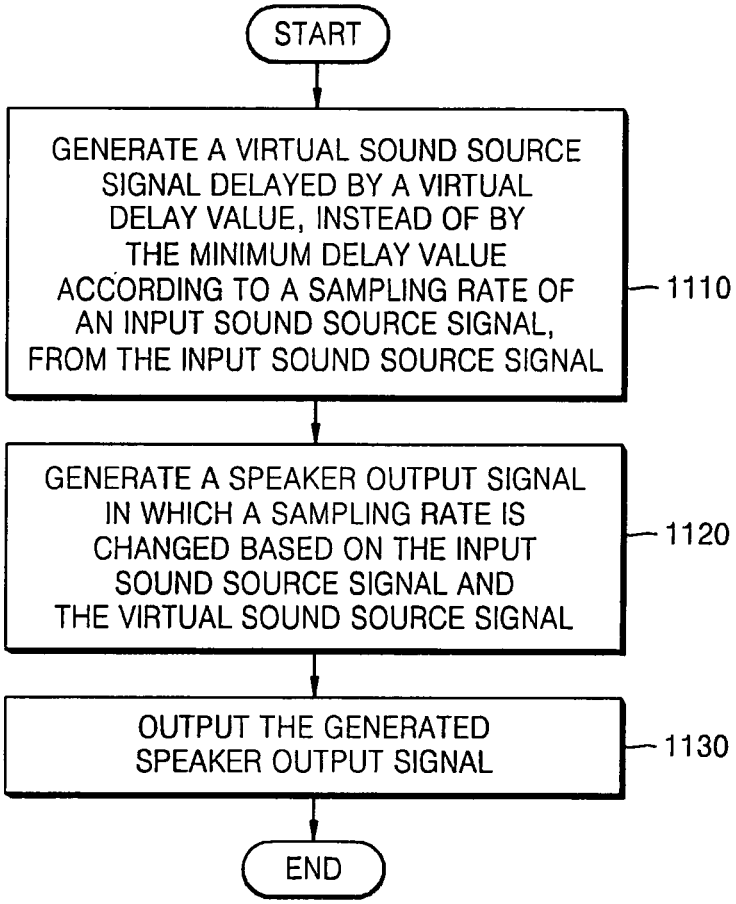
FIG. 11 is a flowchart illustrating a method of outputting a sound source signal using a virtual speaker, according to another embodiment of the present invention.

FIG. 11 is a flowchart illustrating a method of outputting a sound source signal by using a virtual speaker, according to another embodiment of the present invention.

In operation 1110, a virtual sound source signal delayed by a virtual delay value, instead of by the minimum delay value according to a sampling rate of an input sound source signal, is generated from the input sound source signal. Such a virtual sound source signal can be obtained by determining the virtual delay value that is not related to the sampling rate of the input sound source signal and filtering the virtual sound source signal derived from the input sound source signal according to the determined virtual delay value. The input sound source signal delayed by the virtual delay value is defined as a target signal, a coefficient of the filter is controlled to minimize the difference with the defined target signal, and the sound source signal is filtered according to the determined coefficient, thereby performing filtering of the input sound source signal.

In operation 1120, a speaker output signal in which a sampling rate is changed based on the input sound source signal and the virtual sound source signal generated in operation 1110 is generated. Such a speaker output signal can be obtained by synthesizing the sound source signal delayed according to the minimum delay value of the sound source signal from the input sound source signal with the virtual sound source signal generated in operation 1110.

In operation 1130, the speaker output signal generated in operation 1120 is output.

According to the embodiments of the present invention, the speaker output signal in which the sound source signal is delayed, regardless of the sampling rate of the input sound source signal, can be generated by using the virtual speaker. As a result, a near field effect and a non-uniform radiation pattern occurring due to a discontinuous arrangement of the speakers are suppressed and listeners can properly sense directivity of a sound. In addition, the limitation that a frequency band of a controllable sound source signal is restricted due to the size of the fixed speaker array can be overcome.

The computer readable codes on a computer readable recording medium can also be embodied. The computer readable recording medium is any data storage device that can store data which can be thereafter read by a computer system. Examples of the computer readable recording medium include read-only memory (ROM), random-access memory (RA), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, codes, and code segments for accomplishing the embodiment of the present invention can be easily construed by programmers skilled in the art to which the embodiment pertains.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of outputting a sound source signal, the method comprising:

generating from an input sound source signal a virtual sound source signal delayed by a virtual delay value which is less than a minimum delay value, the minimum delay value being equal to a sampling interval of the input sound source signal;

generating a speaker output signal in which the sampling interval is changed based on the input sound source signal and the generated virtual sound source signal; and outputting the generated speaker output signal, wherein the generating of the virtual sound source signal comprises:

determining the virtual delay value; and filtering the virtual sound source signal out from the input sound source signal, the virtual sound source signal being delayed by the determined virtual delay value.

2. The method of claim 1, wherein the filtering of the virtual sound source signal comprises:

defining a sound source signal in which the input sound source signal is delayed by the virtual delay value as a target signal;

controlling a coefficient of a filter to minimize a difference with the defined target signal; and filtering the virtual sound source signal out from the input signal according to the controlled coefficient.

3. The method of claim 1, wherein the generating of the speaker output signal comprises synthesizing the sound source signal delayed according to the minimum delay value from the input sound source signal with the virtual sound source signal.

4. The method of claim 1, further comprising compensating at least one of a gain and a directivity characteristics with respect to the virtual sound source signal.

5. A non-transitory computer readable recording medium having embodied thereon a computer program for executing the method of claim 1.

6. An apparatus for outputting a sound source signal, the apparatus comprising:

a virtual signal generator which generates from an input sound source signal a virtual sound source signal delayed by a virtual delay value which is less than a minimum delay value, the minimum delay value being equal to a sampling interval of the input sound source signal;

a speaker signal generator which generates a speaker output signal in which the sampling interval is changed based on the input sound source signal and the generated virtual sound source signal; and a signal output unit which outputs the generated speaker output signal, wherein the virtual signal generator comprises:

a delay value determining unit which determines the virtual delay value; and a filter which filters the virtual sound source signal out from the input sound source signal, the virtual sound source signal being delayed by the determined virtual delay value.

7. The apparatus of claim 6, wherein the filter defines a sound source signal in which the input sound source signal is delayed by the virtual delay value as a target signal, controls a coefficient of a filter to minimize a difference with the defined target signal, and filters the virtual sound source signal out from the input signal according to the controlled coefficient.

8. The apparatus of claim 6, wherein the speaker signal generator comprises a signal synthesizing unit which synthesizes the sound source signal delayed according to the minimum delay value from the input sound source signal with the virtual sound source signal.

9. The apparatus of claim 6, further comprising a compensation unit which compensates at least one of a gain and a directivity characteristics with respect to the virtual sound source signal.

10. The apparatus of claim 6, wherein the signal output unit is a speaker array and the virtual signal generator controls the virtual delay value to output the virtual speaker output signal from both ends of the speaker array, thereby increasing a size of the speaker array.

* * * * *